US005495811A

United States Patent [19]

Carson et al.

[11] Patent Number: 5,495,811

[45] Date of Patent: Mar. 5, 1996

[54] HEIGHT ADJUSTABLE TABLE

[75] Inventors: David R. Carson; Barry R. Carson, both of Larkspur; John H. Brion, Highlands Ranch, all of Colo.

[73] Assignee: Ergoflex Systems, Larkspur, Colo.

[21] Appl. No.: 222,856

[22] Filed: Apr. 5, 1994

[51] Int. Cl.[6] ..... A47B 9/00

[52] U.S. Cl. ..... 108/147; 108/144

[58] Field of Search ..... 108/147, 144, 108/150; 248/404, 161, 188.5

[56] References Cited

U.S. PATENT DOCUMENTS

| | | | |
|---|---|---|---|
| 496,739 | 5/1993 | Kennedy | 108/144 X |
| 1,839,309 | 1/1932 | Gundel | 248/188.5 X |
| 2,065,952 | 12/1936 | Trautmann | 108/147 X |
| 3,896,744 | 7/1975 | Goebl | 108/150 X |
| 3,908,565 | 9/1975 | Burnett | 108/147 |
| 4,456,212 | 6/1984 | Raftery | 248/558 |
| 4,619,208 | 10/1986 | Kurrasch | 108/144 |
| 4,651,652 | 3/1987 | Wyckoff | 108/144 |
| 4,667,605 | 5/1987 | Bastian | 108/144 |
| 4,711,184 | 12/1987 | Wallin et al. | 108/144 |
| 4,714,025 | 12/1987 | Wallin et al. | 108/20 |
| 4,747,353 | 5/1988 | Watt | 108/146 |
| 4,793,197 | 12/1988 | Petrovsky | 248/161 X |
| 5,022,327 | 6/1991 | Solomon | 108/147 |
| 5,056,278 | 10/1991 | Atsukawa | 248/161 X |
| 5,088,421 | 2/1992 | Beckstead | 108/144 |
| 5,174,223 | 12/1992 | Nagy et al. | 108/50 |
| 5,224,429 | 7/1993 | Borgman et al. | 108/147 |
| 5,234,187 | 8/1993 | Teppo et al. | 248/161 |
| 5,243,921 | 9/1993 | Kruse et al. | 100/147 |
| 5,259,326 | 11/1993 | Borgman et al. | 108/147 |
| 5,282,593 | 2/1994 | Fast | 108/147 X |
| 5,285,733 | 2/1994 | Waibel | 108/144 |
| 5,289,782 | 3/1994 | Rizzi et al. | 108/147 |

FOREIGN PATENT DOCUMENTS

| | | | |
|---|---|---|---|
| 2000081 | 7/1971 | Germany | 108/147 |
| 2603488 | 8/1977 | Germany | 248/161 |
| 4114396 | 10/1991 | Germany | 108/106 |
| 2063837 | 6/1981 | United Kingdom | 312/201 |

*Primary Examiner*—Peter M. Cuomo
*Assistant Examiner*—Janet M. Wilkens
*Attorney, Agent, or Firm*—Sheridan Ross & McIntosh

[57] ABSTRACT

A height-adjustable support assembly having the ability to vary the height of the support surface generally includes a base portion, a support surface, a first member interconnected with and extending upwardly from the base portion, and a second member interconnected with the support surface and movably engaged with the first member. The second member is movable from a first position, to position the support surface at a first height from the base portion, and an extended position, to position the support surface at a second height from the bottom surface. A support structure interconnected with the bottom surface, is provided for supporting the second member at an upper portion thereof when the second member is in the extended position, the upper portion being above an upper end of the first member.

34 Claims, 8 Drawing Sheets

HEIGHT ADJUSTABLE TABLE

FIELD OF THE INVENTION

The present invention generally relates to support structures, such as tables and desks. More specifically, the present invention relates to support structures having height adjusting capabilities to accommodate a variety of user positions, such as sitting and standing, and a variety of user sizes.

BACKGROUND OF THE INVENTION

Office workplace injuries, such as carpal tunnel syndrome, muscle fatigue and back injuries, have dramatically increased over the past several years. New medical terminology for such injuries include Repetitive Motion Injury (RMI), Cumulative Trauma Disease (CTD) and Overuse Syndrome (OS) among others. It is widely accepted that such increase in workplace injuries is a result of information age workers being force to work in a sedentary, constrained position for extended time periods performing highly repetitive tasks. Such injuries are further exacerbated by ergonomically improper working positions.

Costs of worker's compensation claims, lost time, retraining, job reassignment and permanent disability claims associated with such injuries have skyrocketed. Repetitive motion activities performed over an indeterminate period of time (i.e., many years for some operators, a few weeks or months for others) coupled with improper static working posture, inadequate breaks and/or poor working environment are believed to be the cause of nearly 50% of all RMI worker's compensation claims.

Attempts have been made to alleviate the above-noted problems. Many organizations, including the federal government, have instigated policies for reducing the amount of continuous time spent performing repetitive-type motions. For example, many workers are given frequent breaks (e.g., hourly) to allow them to break up the repetitive tasks into shorter segments. Other concepts include job sharing, part-time workers, shorter shifts, and work station rotation.

The above-noted attempts to solve the problems of RMI-type injuries are impractical and/or inefficient in many working situations. Further, none of the above-noted concepts addresses one of the roots of the problem; that is, improper interface between worker and work station. In fact, some of the concepts (e.g., job sharing and work station rotation) may actually exacerbate the problem by rotating workers (e.g., of different physical dimensions) through a single work station which is set up to accommodate the physical dimensions of only a single worker.

As noted above, one of the causes of RMI-type injuries is improper static working position (e.g., improper positioning of the worker relative to his/her work surface, such as a desk or table). Desk and table design has traditionally revolved around the anthropometric requirements of the 95th percentile male user (i.e., about 6' 2" tall) in order to "fit" the widest range of potential users. As a result, most users are forced to work in a position that is not the optimum (i.e., is too high) from a comfort, health and safety standpoint for their own particular physical dimensions, thereby causing the above-noted types of injuries. Further, although allowing a worker to change from a sitting to a standing position has been found to decrease workplace injuries, few desks are designed to allow a worker to stand while working.

Some attempts have been made to design work surfaces which are adjustable in height, thereby allowing modification to fit a range of worker dimensions and/or allowing workers to stand while working. However, many of these designs do not adequately accommodate a range of users from small females to large males. For example, to meet the adjustment range required to serve the 5th percentile sitting female (about 4'11" tall) and the 95th percentile standing male (about 6'2" tall), the work surface height must range from about 25 inches to about 46 inches. Many known designs cannot achieve the above-noted requirement without significant sacrifice of table rigidity due to inadequate extension member support when fully extended. Further, many of the known designs are not easily adjustable, and therefore are sometimes not utilized to their full extent because of the hassle in performing the adjustment procedure.

Accordingly, it is an object of the present invention to design a support assembly, such as a table, desk or chair, that can be easily adjusted to vary the height of the support surface, such as a table top, desk top or chair seat.

Another object of the present invention is to design a support assembly that can be adjusted in height from 25 inches to 46 inches without significant loss of extension member rigidity.

Still another object of the present invention is to design an automatically adjustable support assembly that will automatically move to a selected position by setting a control (e.g., a dial).

It is yet another object of the present invention to design an automatically adjustable support assembly that automatically stops height adjustment (e.g., in the downward direction) if an obstacle is in the way.

It is a further object of the present invention to design an adjustable support assembly requiring substantially no bulky supporting structure or cross braces which may interfere with knee space or obstruct the area required for free movement of the user's legs under the support surface.

SUMMARY OF THE INVENTION

In accordance with the present invention, a height-adjustable support assembly is provided. The assembly is designed to allow full extension of one member relative to another member (e.g., to more than about 180% of the original length) without sacrificing the structural integrity of the assembly (i.e., without excessive "play" between the two members). The assembly generally comprises a base portion having a bottom surface, a support surface, and an adjustable subassembly interconnecting said base portion with the support surface. The adjustable subassembly includes a first member interconnected with and extending upwardly from the base portion and including an upper end and a second member interconnected with the support structure and movably engaged with said first member. The second member is movable relative to the first member between a retracted position, to position the support surface at a first height from the bottom surface, and an extended position, to position the support surface at a second height from the bottom surface. The subassembly further includes means, interconnected with the base portion, for supporting the second member and an upper portion thereof when the second member is in the extended position, the upper portion being above the upper end of the first member.

In one embodiment, the assembly further includes means for limiting movement of the second member relative to the first member. For example, the means for limiting movement may comprise a first protrusion secured to the upper end of the first member and a second protrusion secured to the second member, whereby the first protrusion will engage the second protrusion when the second member is in the extended position. Preferably, the first and second members are cylindrically-shaped tubes, in which case the first and second protrusions may comprise annular bushings.

In another embodiment, the means for supporting comprises a third member slidably engaged with the second member and a fourth member interconnected with and extending upwardly from the base portion, and slidably supporting the third member. Means for limiting relative movement between the second and third members may also be provided to maintain at least 25% overlap, preferably 33% overlap, and more preferably 50% overlap between the second and third members. The means for limiting movement may include a second protrusion secured to the second member and a third protrusion secured to the third member, whereby the second protrusion will engage the third protrusion when the second member is in the extended position. Preferably, the third and fourth members are cylindrically-shaped tubes, in which case the second and third protrusions may be annular bushings.

A means for moving the second member relative to the first member is provided in one embodiment. Such means for moving preferably comprises a threaded rod rotatably interconnected with the second member and threadably interconnected with the base portion, whereby rotation of the threaded rod results in relative movement between the second member and the base portion. The threaded rod may, for example, include a worm-screw. The length of the worm-screw can vary dependent upon different applications and particularly upon desired vertical heights to which the work surface is to be positioned. In a preferred embodiment, the worm screw extends the full vertical height of the tubular member closest to the floor.

The means for moving may further comprise means for rotating the threaded rod. For example, a hand crank may be interconnected with the threaded rod to allow for manual adjustment of the support surface height. Alternatively, a power drive unit may be interconnected with the threaded rod to provide rotational movement thereto. For example, the power drive unit may comprise a DC electric motor. It should be appreciated that other power drive units could also be used.

Preferably, when utilizing a power drive unit, the assembly further comprises means for stopping the power drive unit when the support surface encounters a resistive force. For example, the means for stopping the power drive unit may comprise a pressure-sensitive switch (e.g., a momentary contact switch) positioned between the support surface and the second member. Alternatively, the means for stopping the power drive unit may comprise a pressure-sensitive ribbon switch positioned on a bottom surface of the support surface.

In one embodiment, a number of nesting, telescoping tubular members are used to support a work surface. The number of members forming a single telescoping leg can vary dependent upon the adjustable heights desired and in view of strength, aesthetic and other considerations. For purposes of illustration only, the following detailed description of the invention relates to particular embodiments having specific specifications enumerated. Modifications to the number, size and material composition of described structural components are also included within the scope of the present invention. Regardless of the number of members in a particular telescoping leg, the positioning of bushings on the outer diameter of members nesting within other members is such that they contact bushings located on the inner diameter of overlapping larger members in such a manner that desired rigidity and stability of the telescoping leg is achieved. In a preferred embodiment, bushings are positioned so that nesting members overlap with members adjacently encompassing such members by at least one-quarter, more preferably at least one-third and most preferably, about one-half of the length of the smaller diameter nesting member.

One aspect of the present invention thus relates to the proper positioning of telescoping members with relationship to each other so as to establish a stable and rigid supporting leg structure. Although bushings can be positioned on the interior and exterior diameters of telescoping members to limit the degree of vertical movement with respect to any two telescoping units, other embodiments (not shown) can utilize structures which limit the degree of vertical movement of any two adjacent slidable members, such as bulges in the members themselves, indentations in particular members that accommodate flexible and/or pivotable pins that engage such indentations on internal nesting members, etc.

Another aspect of the present invention relates to the use of a slidably positioned tubular member that "floats" within a telescoping leg structure. Such floating tubular members are positioned vertically by engagement of bushings, for example, on the exterior diameter of such floating support member and the interior diameter of an adjacent, larger diameter member.

By virtue of the present invention, the support surface can be set to accommodate a 5% sitting female and adjusted to accommodate a 95% standing male, without significantly sacrificing the structural rigidity of the assembly. Such an assembly allows the support surface to be adjusted to the proper ergonomic requirements of the user. Further, the assembly allows use of the support surface in either the sitting of standing positions, thereby further enhancing the ergonomic advantages of the assembly.

DETAILED DESCRIPTION

Figure 1:
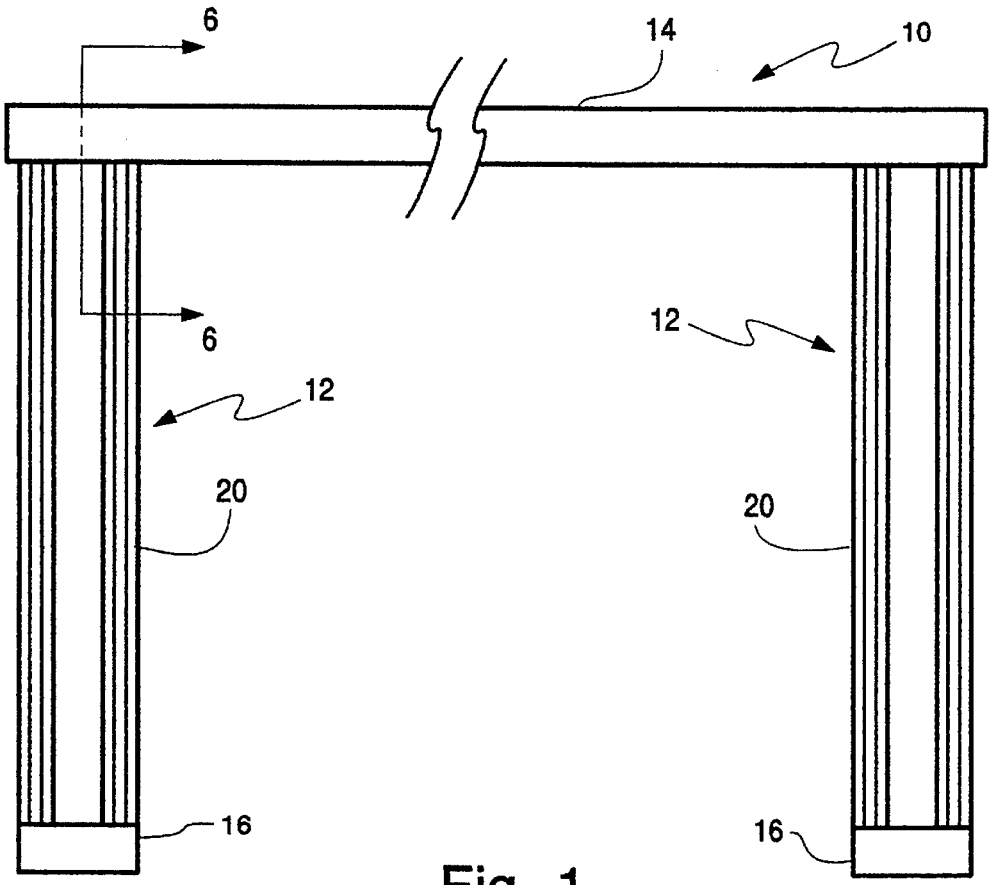
FIG. 1 is a front elevation view of a table embodying the present invention.
Figure 2:
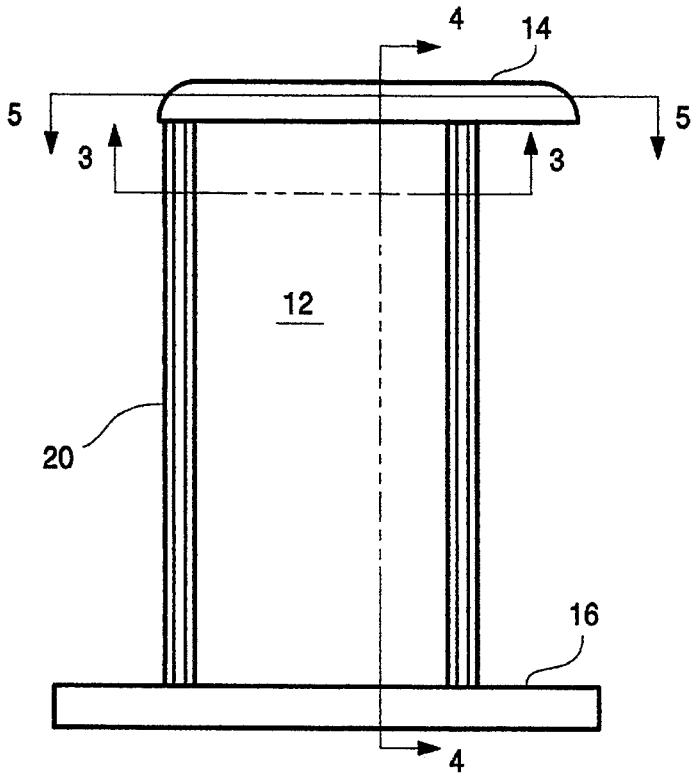
FIG. 2 is a side elevation of the table illustrated in FIG. 1.

An adjustable support assembly embodying the present invention is illustrated in FIGS. 1–4. As used herein, adjustable support assemblies may include tables, desks and/or chairs. Briefly, in the illustrated embodiment of the present invention, the support assembly comprises a table 10 having two telescoping subassemblies 12 supporting a table top 14 at both ends thereof. Each telescoping subassembly 12 is movable vertically to adjust the height of the table top 14 from about 25 inches to about 46 inches. In the present embodiment, such movement is accomplished utilizing an electric motor 22, as will be described below in more detail.

Figure 3:
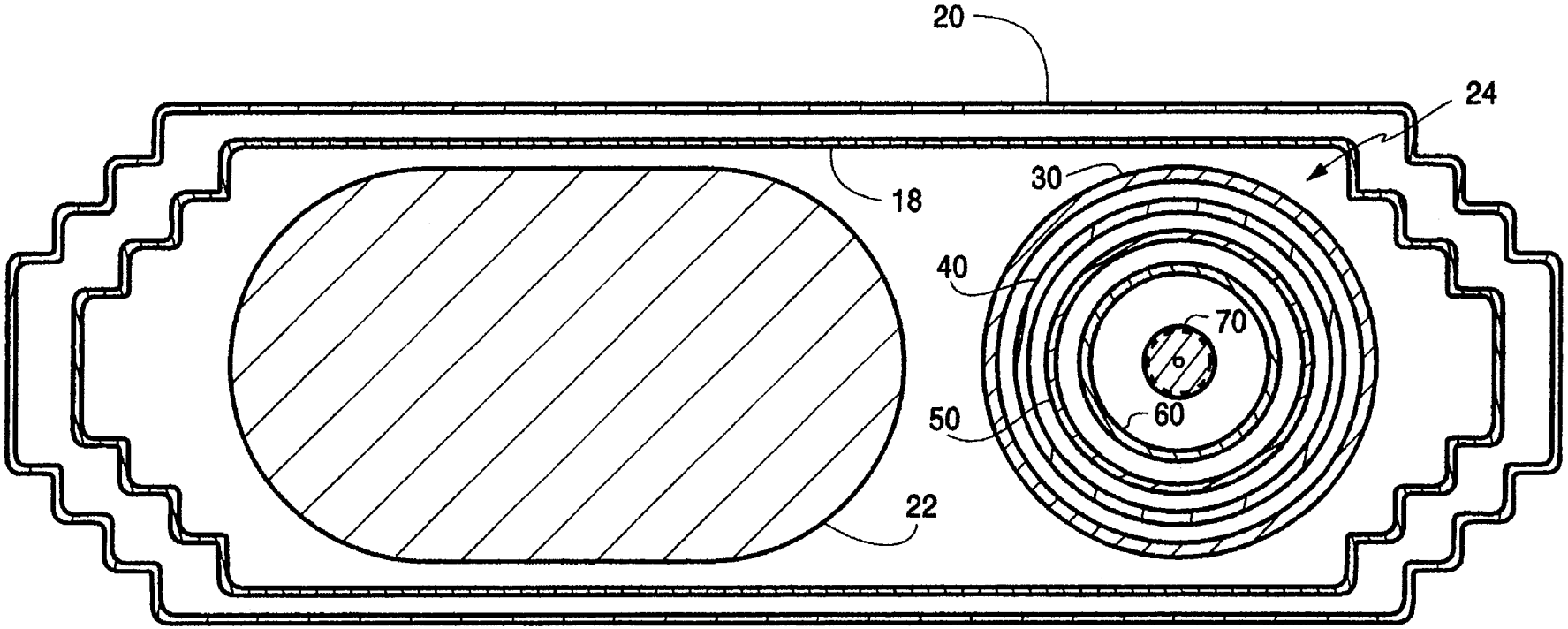
FIG. 3 is a section view taken along line 3—3 in FIG. 2 showing the location of the telescoping members.

The telescoping subassemblies 12 will be described with reference to FIGS. 3 and 4. The two telescoping subassemblies 12 are substantially identical and, therefore, only one will be described herein, except as specifically noted. The telescoping subassembly 12 includes a base member 16 for providing support to the rest of the subassembly 12. In the present embodiment, the base member 16 comprises an elongated rectangular channel iron. It should be appreciated, however, that a variety of different configurations may be used for the base member 16 to accommodate different uses of the support surface (e.g., table top 14). It should also be appreciated that in other embodiments, only one adjustable telescoping member is used to support the support surface, while still other embodiments utilize two or more members.

In a preferred embodiment, inner and outer housings 18, 20 are utilized for concealing the motor 22 and lift mechanism 24 from view and for protecting the user from contact with the internal mechanisms of the table 10. The inner housing 18 is secured to the base member 16, and the outer housing 20 is secured to an upper plate 26. The inner and outer housings 18, 20 engage each other in a telescoping manner such that, when the lift mechanism 24 raises the table top 14, the outer housing 20 moves upward relative to the inner housing 18 while shielding the internal mechanisms from the user. The housings of the illustrated embodiment are manufactured from plastic and are preferably ornamentally designed to improve the aesthetic appearance of the table 10.

In one embodiment, within the housings is a set of four concentric tubular members. A first tubular member 30 is secured at the lower end thereof to the base member 16 and extends upwardly therefrom. The first tubular member 30 of the illustrated embodiment is a 3 inch outer diameter cylindrical tube having a 0.120 inch wall thickness and a length of about 23 inches. A first upper bushing 32 having an inner diameter of about 2.510 inches is secured to the upper end of the first tubular member 30 for slidably supporting a second tubular member 40 within the first tubular member 30.

The second tubular member 40 is slidably positioned within the first tubular member 30 and is secured to the upper plate 26 at the upper end thereof. The second tubular member 40 of the illustrated embodiment is a 2½ inch outer diameter cylindrical tube having a 0.083 inch wall thickness and a length of about 23¼ inches. A first lower bushing 42 having an outer diameter of about 2.749 inches is secured to the lower end of the second tubular member 40 (i.e., on the outside surface thereof). The first lower bushing provides supportive engagement with the first tubular member 30 and also is engagable with the first upper bushing 32 to limit the relative upward telescoping movement of the first and second tubular members 40. A second lower bushing 44 having an inner diameter of about 2.009 inches is secured to the lower end of the second tubular member 40 (i.e., on the inside surface thereof). The second lower bushing 44 slidably supports a third tubular member 50 within the second tubular member 40 and is further engagable with a inner bushing 54 to limit relative telescopic movement of the second and third tubular members 50.

The third tubular member 50 is slidably positioned within the second tubular member 40 and is designed to act as a floating support for the second tubular member 40. The third tubular member 50 of the illustrated embodiment is a 2 inch outer diameter cylindrical tube having a 0.065 inch wall thickness and a length of about 23¼ inches. A second upper bushing 52 having an outer diameter of about 2.324 inches is secured to the upper end of the third tubular member 50 (i.e., on the outside surface thereof). The second upper bushing 52 provides supportive engagement with the second tubular member 40. A inner bushing 54 having an outer diameter of about 2.305 inches is secured to a mid portion (i.e., at about the center of the length) of the third tubular member 50 (i.e., on the outside surface thereof). As noted above, the inner bushing 54 is engagable with the second lower bushing 44 to limit relative telescopic movement of the second and third tubular members 50. A third lower bushing 56 having an inner diameter of about 1.508 inches is secured to the lower end of the third tubular member 50 (i.e., on the inside surface thereof). The third lower bushing 56 slidably supports a fourth tubular member 60 within the third tubular member 50.

The fourth tubular member 60 is secured at the lower end thereof to the base member 16 and extends upwardly therefrom. The fourth tubular member 60 is designed to act as an internal rigid support for the second and third tubular members 40, 50. The fourth tubular member 60 of the illustrated embodiment is a 1½ inch outer diameter cylindrical tube having a 0.065 inch wall thickness and a length of about 22½ inches. An internally threaded bushing 62 having an outer diameter of about 1.862 inches is secured to the upper end of the fourth tubular member 60. The outer diameter of the internally threaded bushing 62 provides supportive engagement to the third tubular member 50. The internal threads are formed through the full length of the bushing, concentric with the fourth tubular member 60, and are designed to threadably receive a worm screw 70 therein. In the illustrated embodiment, the threads are ½ inch×0.200 RH, dual start. The threaded bushing 62 can be manufactured from any suitable material, but it has been found that a polymer material, such as Delrin, is especially preferred.

As noted, a worm screw 70 is threadably engaged with the threaded bushing 62 secured to the upper portion of the fourth tubular member 60. The worm screw 70 of the illustrated embodiment comprises a ½ inch×0.200 RH, dual start threaded portion having a length of about 22¾ inches. A 0.25 inch diameter mounting boss 72 extends about 1.75 inches from one end of the threaded portion. The mounting boss 72 is threaded (e.g., ¼–20) to allow for securement of the mounting boss 72 to the top portion of the second tubular member 40, as described below in more detail.

Figure 4A:
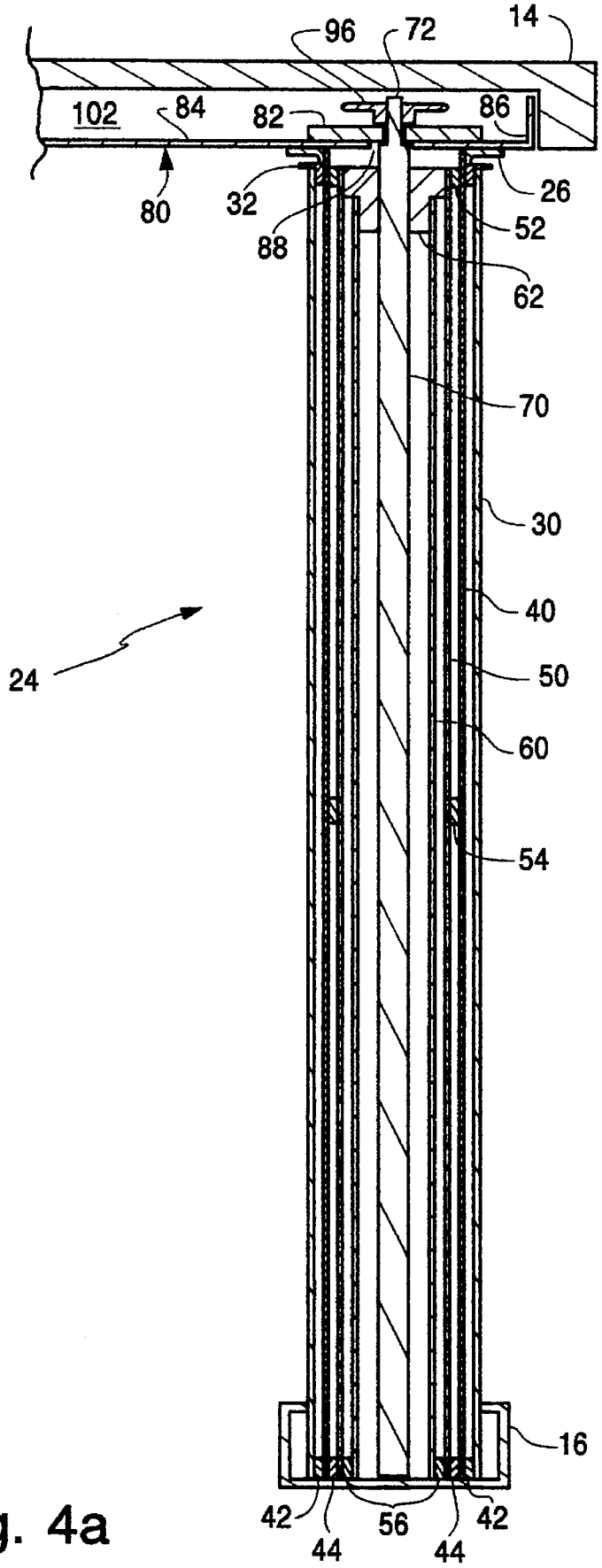
FIGS 4*a*–4*d* are section views taken along line 4—4 in FIG. 2 showing one leg of the illustrated table at several locations along its travel.
Figure 6:
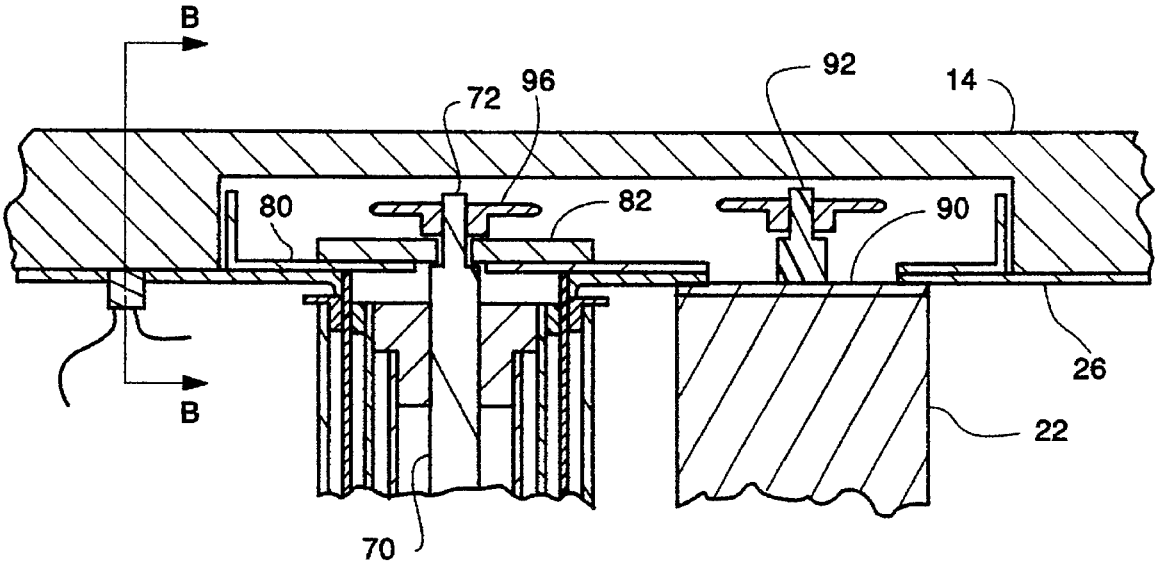
FIG. 6 is a section view, taken along line 6—6 in FIG. 1.

As noted above, an upper plate 26 is secured (e.g., welded) to the upper portion of the second tubular member 40. The upper plate 26 is provided to allow securement of the table top 14 and associated components to the second tubular member 40. For example, a pan member 80 is sandwiched between the upper plate 26 and a bearing plate 82 via four screws (not shown). The pan member 80 of the illustrated embodiment is a longitudinally-extending rectangular piece of sheet metal (e.g., stainless steel) having a rectangular bottom portion 84 and four upstanding sidewall portions 86, as shown in FIG. 4*a*. The pan member 80 includes a hole 88 in both ends thereof to allow extension of the worm screw 70 therethrough. Another hole 90 is provided in one end thereof to allow protrusion of the motor drive shaft 92 therethrough, as shown in FIG. 6. The pan member 80 is designed to house the power transmission mechanism (i.e., chains and sprockets) therewithin, thereby protecting the mechanism from contamination and preventing contact with the user.

As noted, the bearing plate 82 sandwiches the pan member 80 between itself and the upper plate 26 via four screws. The bearing plate 82 of the illustrated embodiment comprises a ¼ inch steel plate with a hole through the center thereof for insertably receiving the mounting boss 72 of the worm screw 70 therein. A bearing assembly (not shown) interconnects the bearing plate 82 to the worm screw 70 and allows for rotational, but not axial, movement therebetween. For example, the bearing assembly of the present embodiment comprises a combination thrust-rotational bearing.

A sprocket 96 is secured (e.g., via a roll pin) to the mounting boss 72 adjacent the bearing plate 82. The sprocket 96 is designed to be engaged and driven by a chain, which is driven by the motor 22, described below.

Figure 5:
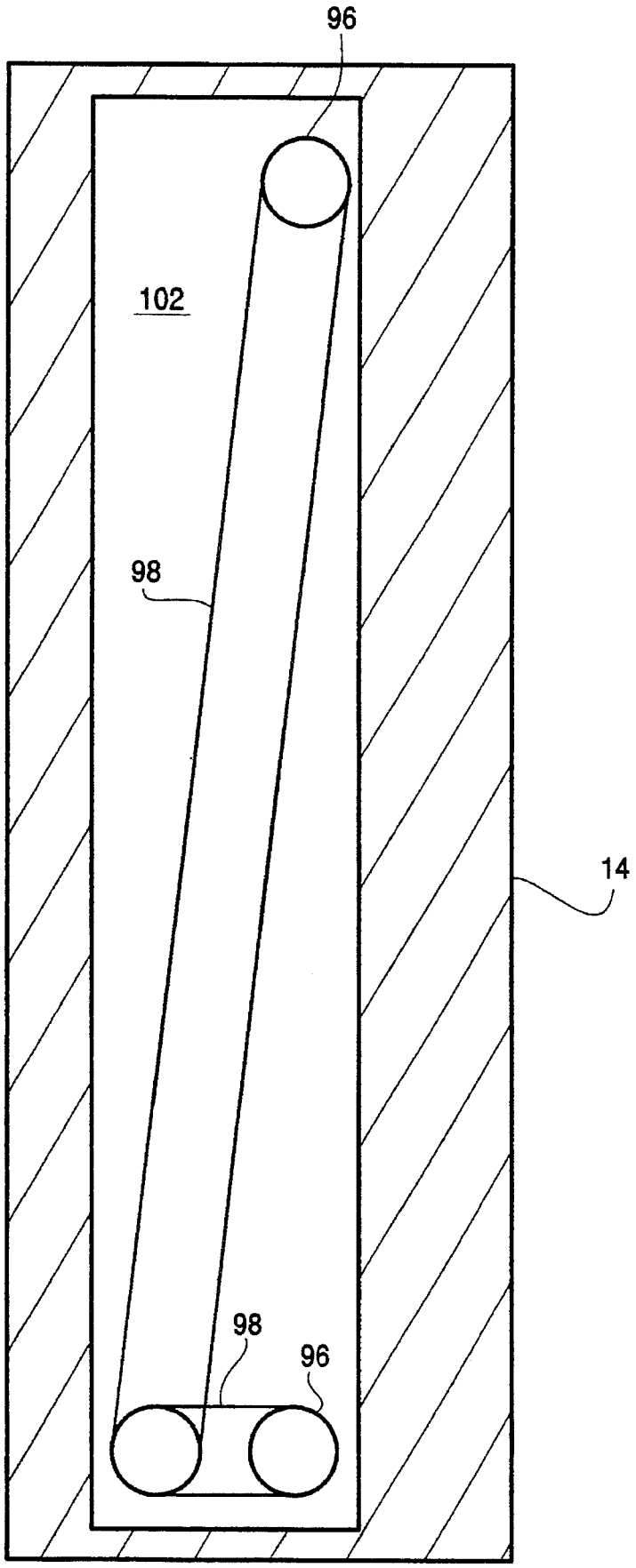
FIG. 5 is a section view, taken along line 5—5 in FIG. 2, showing the recessed portion of the table top.

The table top 14 is secured (e.g., via screws 100) to the upper plate 26. An important feature of the present invention is that the table top 14 includes a recessed portion 102 in the bottom portion 84 thereof, as illustrated in FIGS. 4*a* and 5. The recessed portion 102 is dimensioned to receive the pan member 80 and associated drive components (e.g., the sprockets and chains) therein. As such, there are no mechanical components and/or structural supports extending substantially below the bottom of the table top 14, thereby providing desired clearance for the user's legs.

Figure 4B:
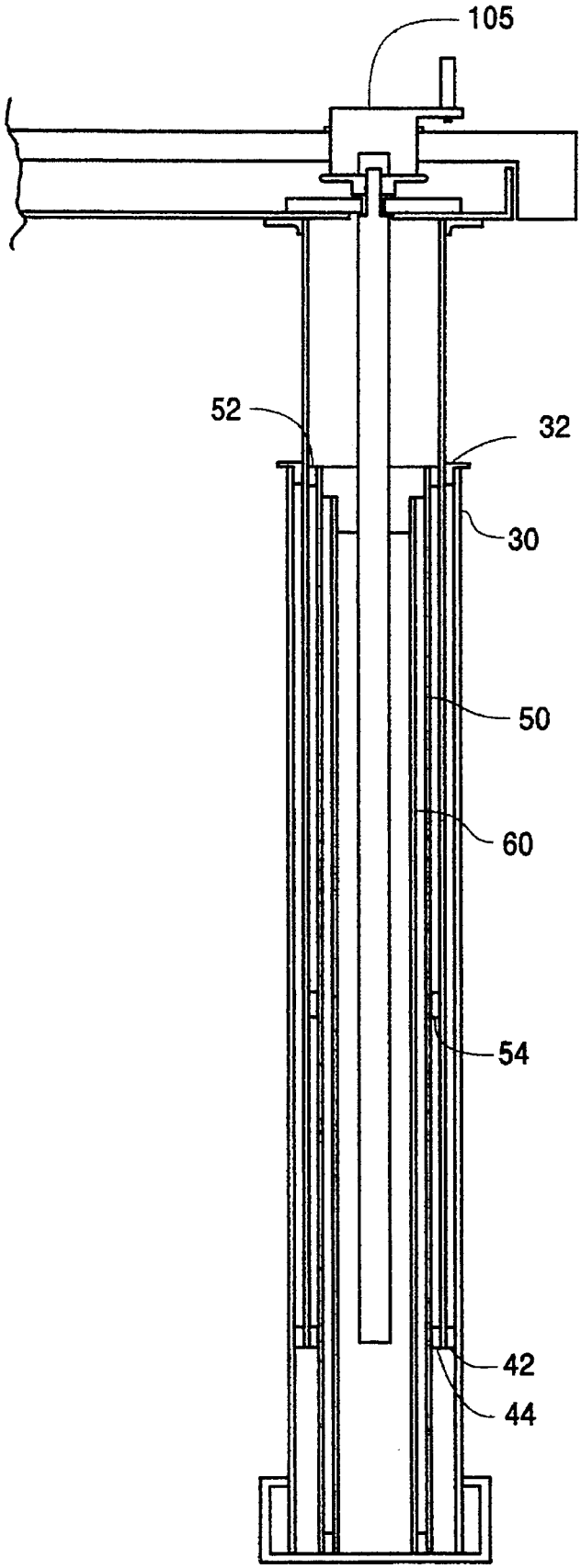
Figure 4C:
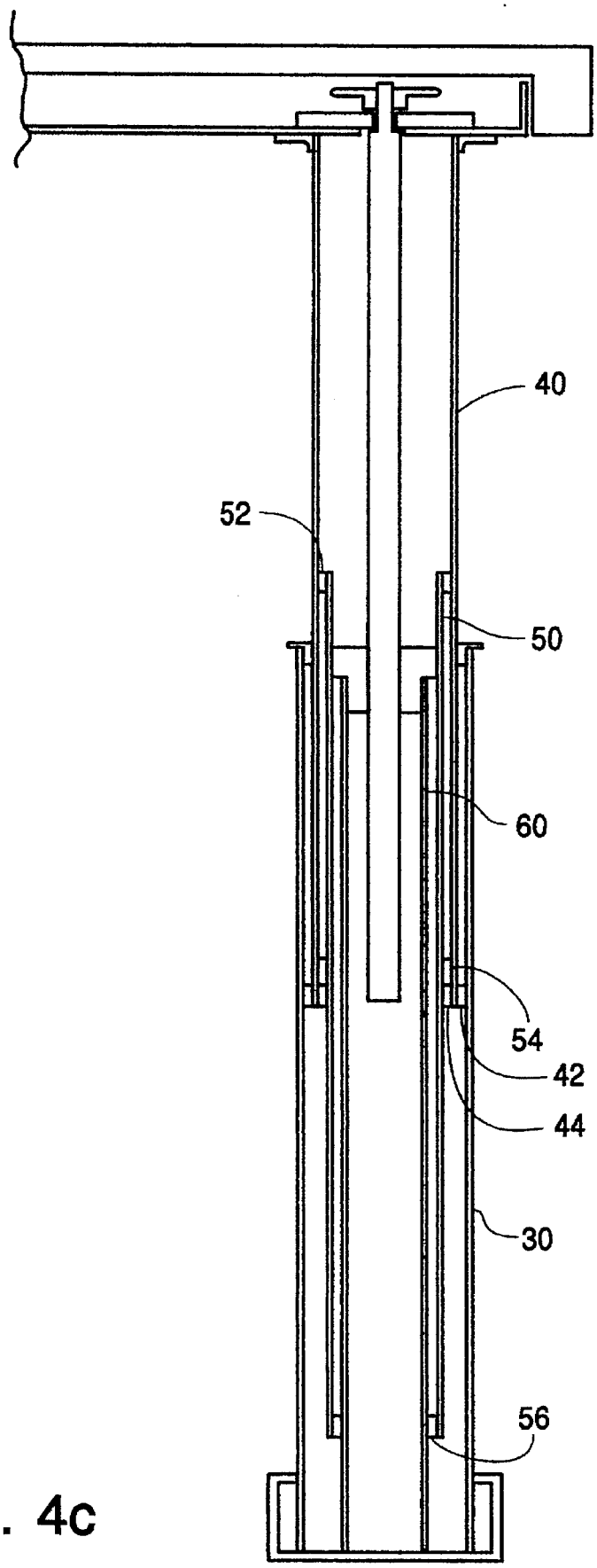

It should be appreciated that, with the above-described subassembly 12, rotation of the sprocket 96 in the appropriate direction will result in the worm screw 70 moving upward, away from the base member 16. Because of the interaction between the worm screw 70, bearing assembly, bearing plate 82, upper plate 26, and second tubular member 40, such upward movement of the worm screw 70 will cause upward extension of the second tubular member 40 relative to the first tubular member 30, as shown in FIG. 4*b*. Such upward extension of the second tubular member 40 eventually causes the second lower bushing 44 to contact the inner bushing 54. Further upward movement of the second tubular member 40 results in upward extension of the third tubular member 50 relative to the fourth tubular member 60, as shown in FIG. 4*c*. Such movement of the second and third tubular members 50 may continue until the first lower bushing contacts the first upper bushing 32, as shown in FIG. 4*d*.

Figure 4D:
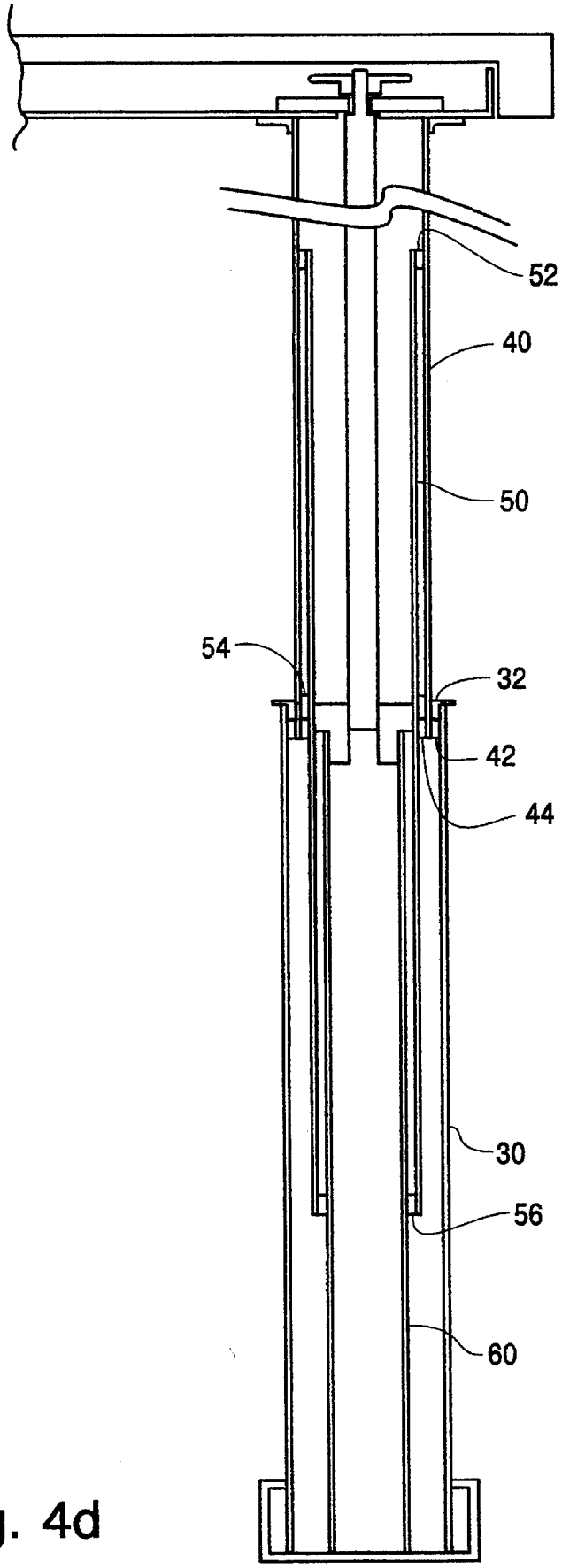

It can be seen from FIG. 4*d* that the second tubular member 40 is fully extended relative to the first tubular member 30, thereby almost doubling the length of the telescoping subassembly 12. However, rather than merely being supported by the small overlap between the first upper bushing 32 and the first lower bushing, support to the second tubular member 40 is also provided by the second and third tubular members 50. It can be seen that the overlap between the second and third tubular members 50 and the overlap between the third and fourth tubular members 60 is about half the length of the respective tubular members. That is, the distance from the second lower bushing 44 and the second upper bushing 52 is about half the length of the second tubular member 40, thereby resulting in a joint which is more sturdy (i.e., has less lateral play) than one which has less overlap, other parameters being equal. The same is true for the joint between the third and fourth tubular members 60. As such, the second tubular member 40 is supported from both the interior and the exterior.

As noted above, each table 10 generally comprises two telescoping subassemblies 12. One of the two telescoping subassemblies 12 includes a motor 22 positioned within the outer housing 20, adjacent the sprocket 96, as shown in FIG. 6. The motor 22 includes a drive shaft 92 interconnected with a drive sprocket 93. The drive sprocket 93 engages two drive chains 98 which are engaged with the sprockets 96 on the respective telescoping subassemblies 12. The motor 22 of the illustrated embodiment is a 24 volt DC motor, such as that available from RAE Corporation. However, it should be appreciated that other types of motors could be used instead. In addition, other drive mechanisms may be used, such as belts or cables.

The motor 22 is supplied with power via an electric circuit. The electric circuit comprises a power source, such as a standard 120 volt AC outlet. The power is provided to a transformer where the power is converted to 24 volt DC power. The 24 volt DC circuit includes a stop switch for manually stopping movement of the table 10 at any desired time.

Figure 7:
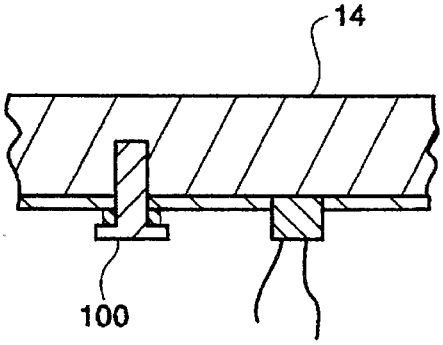
FIG. 7 is a section view, taken along line 7—7 in FIG. 6.

A pressure switch is provided for automatically stopping movement of the table 10 if there is more than a predetermined resistance to such movement. For example, the pressure switch can be set to stop if there is something (e.g., a chair) beneath the table 10 obstructing downward movement of the table top 14. The safety switch of the illustrated embodiment comprises a momentary contact switch mounted to the upper plate 26 between the upper plate 26 and the table top 14, as shown in FIG. 7. The table top 14 of the illustrated embodiment is designed such that it actually "floats" on the upper plate 26; that is, there is a small amount of movement of the table top 14 relative to the upper plate 26 if a sufficient force pushes up on the table top 14. If such relative movement should occur, the circuit breaker will detect it and will automatically break the 24 volt DC circuit. Such break in the circuit is maintained by a circuit breaker until the breaker is reset, thereby allowing time to remove the obstruction from beneath the table 10.

In an alternative embodiment, the pressure switch comprises a "ribbon switch" such as that available from the Tape Switch Corporation of Farmingdale, N.Y. The ribbon switch is a pressure-sensitive switch which can be secured (e.g., by adhesive) to the bottom of the table top 14 such that, when the ribbon switch is contacted with a predetermined amount of pressure, (e.g., 8 ounces nominal finger pressure), a circuit breaker will be flipped, thereby stopping movement of the table top 14. Preferably, the ribbon switch is about 5/32 inches thick and 9/16 inches wide and is secured to the bottom edge of the table 10, around the perimeter thereof.

The electric circuit preferable further includes a PC board (not shown) for controlling the position of the lift mechanism 24. The PC board includes memory capabilities which enables the PC board to constantly keep track of the precise location of the lift mechanism 24. The PC board is preferably interconnected with a user-changeable control which allows the user to select the desired height of the table top 14. For example, the control may comprise a potentiometer. By comparing the potentiometer reading to the actual height of the table 10, the PC board is able to make appropriate adjustments to the table 10 in response to changes in the potentiometer input by the user.

It should be appreciated that, instead of utilizing an electric motor 22, the support assembly could be operated manually. For example, the mounting bars of the worm screw 70 could be fitted with a hand crank 105 to allow movement of the lift mechanism 24 by rotating the hand crank.

It can be seen from FIG. 4*d* that, due to the small overlap between the first and second members, most of the support to the second member is provided by the interaction between the fourth, third, and second members (i.e., from the inside of the second member). Accordingly, in one embodiment of the present invention, the lift mechanism 24 does not utilize a first member. That is, there are only three members, each overlapping the adjacent member by at least 25% of its length, preferably 33% of its length, and more preferably 50% of its length.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A height-adjustable support assembly comprising:

a base portion;

a base support surface; and adjustable subassembly interconnecting said base portion with said support surface, said adjustable subassembly comprising:

a first member interconnected with said base portion;

a second member interconnected with said support surface, said second member being extendable relative to said first member between a retracted position and an extended position;

a third member slidably engaged with and floatably extendable relative to said first member, said third member being slidably engaged with said second member;

a means, interconnected with said second member and threadably interconnected with said base portion, for moving said second member relative to said first member, said means for moving comprising a single threaded rod and a means for rotating said single threaded rod, wherein said means for rotating said single threaded rod comprises a power drive unit;

means, associated with said second and third members, for preventing further extensive movement of said second member relative to said third member when said second member has extended to a first position relative to said third member, said third member being floatably extendable relative to said first member as said single threaded rod extends said second member relative to said first member to said extended position; and a telescoping shell surrounding said first, second, and third members, wherein said power drive unit is positioned within said telescoping shell.

2. A height-adjustable support assembly, as set forth in claim 1, wherein said telescoping shell comprises a first shell member interconnected with said support surface and a second shell member telescopically engaged with said first shell member and interconnected with said base portion.

3. A height-adjustable support assembly, as set forth in claim 1, said third member having first and second ends defining a length of said third member, wherein:

said first position corresponds with an overlap between said second and third members of at least about 25 percent of said length of said third member.

4. A height-adjustable support assembly, as set forth in claim 3, wherein:

said overlap is about 50 percent of said length of said third member.

5. A height-adjustable support assembly comprising:

a base portion;

a base support surface;

a mechanical drive link positioned within a recess in said support surface; and two adjustable subassemblies interconnecting said base potion with said support surface, each of said adjustable subassemblies comprising:

a first member interconnected with said base portion;

a second member interconnected with said support surface, said second member being extendable relative to said first member between a retracted position and an extended position;

a third member slidably engaged with and floatably extendable relative to said first member, said third member being slidably engaged with said second member;

a means, interconnected with said second member and threadably interconnected with said base portion, for moving said second member relative to said first member, said means for moving comprising a single threaded rod, wherein said threaded rods of said two subassemblies are interconnected via said mechanical drive link positioned within said recess in said support surface; and means, associated with said second and third members, for preventing further extensive movement of said third member relative to said second member when said third member has extended to a first position relative to said second member, said third member being floatably extendable relative to said first member as said single threaded rod extends said second member relative to said first member to said extended position.

6. A height-adjustable support assembly, as set forth in claim 5, wherein said drive link is a member selected from a group consisting of a chain, a cable, and a belt.

7. A height-adjustable support assembly, as set forth in claim 5, wherein a sitting area is defined between said two adjustable subassemblies, a bottom of said support surface, and a bottom plane defined by a bottom of said base portion, and wherein said sitting area is substantially free of obstructions.

8. A height-adjustable support assembly comprising:

a base portion;

a support surface; and an adjustable subassembly interconnecting said base portion with said support surface, said adjustable subassembly comprising:

a first member interconnected with said base portion;

a second member interconnected with said support surface and slidably engaged with said first member, said second member being movable relative to said first member between a retracted position and an extended position;

a third member slidably engaged with said second member and floatably extendable relative to a fourth member, said fourth member interconnected with said base portion, said fourth member being slidably engaged with said third member;

a means, interconnected with said second member and threadably interconnected with said base portion, for moving said second member relative to said first member, said means for moving comprising a single threaded rod;

means for preventing further extensive movement of said second member relative to said third member when said second member has extended to a first position relative to said third member, said third member being floatably extendable relative to said fourth member as said single threaded rod extends said second member relative to said first member to said extended position, to thereby provide support to said second member when said second member is in said extended position; and means for limiting movement of said second member relative to said first member, said means for limiting movement comprising a first engaging member secured to one of said first and second members and a second engaging member secured to the other of said first and second members, whereby said first engaging member will contact said second engaging member when said second member has extended to said extended position to thereby prevent further extensive relative movement between said first and second members.

9. A height-adjustable support assembly, as set forth in claim 8, wherein said first and second members are tubes.

10. A height-adjustable support assembly, as set forth in claim 9, wherein at least one of said tubes is cylindrical.

11. A height-adjustable support assembly, as set forth in claim 8, wherein said first and second engaging members are bushings.

12. A height-adjustable support assembly, as set forth in claim 11, wherein said bushings are annular.

13. A height-adjustable support assembly, as set forth in claim 8, wherein means for preventing further extensive movement comprises an inner engaging member within said second member and an outer engaging member on said third member.

14. A height-adjustable support assembly, as set forth in claim 13, wherein said inner and outer engaging members are bushings.

15. A height-adjustable support assembly, as set forth in claim 8, said third member having first and second ends defining a length of said third member, wherein said extended position corresponds with an overlap between said second and third members of at least about 25 percent of said length of said third member.

16. A height-adjustable support assembly, as set forth in claim 15, wherein said overlap is about 50 percent of said length of said third member.

17. A height-adjustable support assembly, as set forth in claim 8, further comprising means for rotating said single threaded rod.

18. A height-adjustable support assembly, as set forth in claim 17, wherein said means for rotating said single threaded rod comprises a manually operated crank.

19. A height-adjustable support assembly, as set forth in claim 17, wherein said means for rotating said single threaded rod comprises a power drive unit.

20. A height-adjustable support assembly, as set forth in claim 19, further comprising a telescoping shell surrounding said first, second, third and fourth members, wherein said power drive unit is positioned within said telescoping shell.

21. A height-adjustable support assembly, as set forth in claim 20, wherein said telescoping shell comprises a first shell member interconnected with said support surface and a second shell member telescopically engaged with said first shell member and interconnected with said base portion.

22. A height-adjustable support assembly, as set forth in claim 19, wherein said power drive unit comprises a DC electric motor.

23. A height-adjustable support assembly, as set forth in claim 19, further comprising means for stopping said power drive unit when said support assembly encounters a resistive force.

24. A height-adjustable support assembly, as set forth in claim 23, wherein said means for stopping said power drive unit comprises a pressure-sensitive switch.

25. A height-adjustable support assembly, as set forth in claim 24, wherein said pressure-sensitive switch is positioned between said support surface and said second member.

26. A height-adjustable support assembly, as set forth in claim 25, wherein said pressure-sensitive switch is positioned on a bottom of said support surface.

27. A height-adjustable support assembly, as set forth in claim 26, wherein said pressure-sensitive switch comprises a ribbon switch.

28. A height-adjustable support assembly, as set forth in claim 8, wherein said support assembly includes two of said adjustable subassemblies, and wherein said single threaded rods of said two subassemblies are interconnected via a mechanical drive link position within a recess in said support surface.

29. A height-adjustable support assembly, as set forth in claim 28, wherein said drive link is a member selected from the group consisting of a chain, a cable, and a belt.

30. A height-adjustable support assembly, as set forth in claim 28, wherein a sitting area is defined between said two adjustable subassemblies, a bottom of said support surface and a bottom plane defined by a bottom of said base portion, and wherein said sitting area is substantially free of obstructions.

31. A height-adjustable support assembly, as set forth in claim 8, wherein a distance between a bottom of said base portion and a top of said support surface is adjustable between about 25 inches and about 46 inches.

32. A height-adjustable table comprising:

a base portion;

a table top; and an adjustable subassembly interconnecting said base portion with said table top, said adjustable subassembly comprising:

a first tube interconnected with and extending upwardly from said base portion;

a second tube interconnected with said table top and slidably positioned within said first tube, said second tube being extendable relative to said first tube between a retracted position and an extended position, said second tube including an inner engaging member;

a third tube slidably positioned within said second tube and floatably extendable relative to a fourth tube, said third tube including an outer engaging member, said fourth tube interconnected with and extending upwardly from said base portion, said third tube being slidable relative to said fourth tube; and a single threaded rod interconnected with said second tube for moving said second tube relative to said first tube whereby movement of said second tube by said single threaded rod from said retracted position to said extended position results in engagement of said inner engaging member of said second tube with said outer engaging member of said third tube to thereby cause said third tube to floatably extend relative to said first tube and support said second tube from an interior thereof.

33. A height-adjustable support assembly comprising:

a base portion;

a base support surface; and adjustable subassembly interconnecting said base portion with said support surface, said adjustable subassembly comprising:

a first member interconnected with said base portion;

a second member interconnected with said support surface, said second member being extendable relative to said first member between a retracted position and an extended position;

a third member slidably engaged with and floatably extendable relative to said first member, said third member being slidably engaged with said second member;

a means interconnected with said second member and threadably interconnected with said base portion, for moving said second member relative to said first member, said means for moving comprising a single threaded rod; and means, associated with said second and third members, for preventing further extensive movement of said second member relative to said third member when said second member has extended to a first position relative to said third member, said third member being floatably extendable relative to said first member as said single threaded rod extends said second member relative to said first member to said extended position, wherein said extended position of said second member corresponds with a maximum height of said support surface.

34. A height-adjustable support assembly comprising:

a base portion;

a base support surface; and an adjustable subassembly interconnecting said base portion with said support surface, said adjustable subassembly comprising:

a first member interconnected with said base portion;

a second member interconnected with said support surface and slidably engaged with said first member, said second member being movable relative to said first member between a retracted position and an extended position;

a third member slidably engaged with said second member and floatably extendable relative to a fourth member, said fourth member interconnected with said base portion, said fourth member being slidably engaged with said third member;

a means, interconnected with said second member and threadably interconnected with said base portion, for moving said second member relative to said first member, said means for moving comprising a single threaded rod; and means for preventing further extensive movement of said second member relative to said third member when said second member has extended to a first position relative to said third member, said third member being floatably extendable relative to said fourth member as said single threaded rod extends said second member relative to said first member to said extended position, to thereby provide support to said second member when said second member is in said extended position, wherein said extended position of said second member corresponds with a maximum height of said support surface.

* * * * *